US010678282B1

(12) United States Patent
Pannizzo

(10) Patent No.: US 10,678,282 B1
(45) Date of Patent: Jun. 9, 2020

(54) LINEAR VOLTAGE REGULATORS AND ASSOCIATED METHODS

(71) Applicant: Maxim Integrated Products, Inc., San Jose, CA (US)

(72) Inventor: Ivo Pannizzo, Gravina di Catania (IT)

(73) Assignee: Maxim Integrated Products, Inc., San Jose, CA (US)

( * ) Notice: Subject to any disclaimer, the term of this patent is extended or adjusted under 35 U.S.C. 154(b) by 0 days.

(21) Appl. No.: 16/243,378

(22) Filed: Jan. 9, 2019

Related U.S. Application Data

(60) Provisional application No. 62/615,092, filed on Jan. 9, 2018.

(51) Int. Cl.
*G05F 1/565* (2006.01)
*G05F 1/575* (2006.01)

(52) U.S. Cl.
CPC ..... *G05F 1/565* (2013.01); *G05F 1/575* (2013.01)

(58) Field of Classification Search
CPC ..... G05F 1/565; G05F 1/575; G05F 1/573; G05F 1/5735
See application file for complete search history.

(56) References Cited

U.S. PATENT DOCUMENTS 4,618,813 A * 10/1986 Vesce ..... G05F 1/56 323/268
5,642,034 A * 6/1997 Amano ..... G05F 1/573 323/275
6,509,722 B2 1/2003 Lopata
6,531,851 B1 * 3/2003 Lenk ..... G05F 1/575 323/280
6,667,606 B2 12/2003 Oglesbee et al.
6,750,638 B1 * 6/2004 Gang ..... G05F 1/575 323/280
7,161,393 B1 1/2007 Potanin et al.
2003/0076638 A1 * 4/2003 Simonelli ..... G05F 1/571 361/56
2016/0099644 A1 * 4/2016 Tsuzaki ..... G05F 1/573 323/271
2017/0110880 A1 * 4/2017 Chen ..... H02M 7/493

* cited by examiner

*Primary Examiner* — Harry R Behm
(74) *Attorney, Agent, or Firm* — Lathrop GPM LLP

(57) ABSTRACT

A linear voltage regulator includes a series-pass element electrically coupled between an input node and an output node, current sense circuitry configured to generate a current sense signal representing at least magnitude of current flowing through the series-pass element, and control circuitry. The control circuitry is configured to control the series-pass element according to at least (a) the current sense signal and (b) a voltage sense signal representing magnitude of an output voltage, to clamp the magnitude of the output voltage to a maximum value, where the output voltage is a voltage at the output node, such that the magnitude of the output voltage decreases with increasing magnitude of current flowing through the series-pass element.

16 Claims, 17 Drawing Sheets

LINEAR VOLTAGE REGULATORS AND ASSOCIATED METHODS

RELATED APPLICATIONS

This application claims benefit of priority to U.S. Provisional Patent Application Ser. No. 62/615,092, filed Jan. 9, 2018, which is incorporated herein by reference.

BACKGROUND

Linear regulators are a class of voltage regulators where output voltage is controlled by varying voltage drop across a series-pass element, typically a transistor. Linear regulators have significant advantages over other types of voltage regulators in certain applications. For example, linear regulators do not generate switching noise, and linear regulators do not incur switching losses. Additionally, linear regulators do not require energy storage inductors, thereby promoting small regulator size, low regulator cost, and fast transient response. Furthermore, linear regulators can achieve high efficiency in low-current applications and/or in applications where output voltage magnitude is close to input voltage magnitude.

FIG. 1 illustrates a conventional linear regulator 100 including a transistor 102, an output capacitor 104, and control circuitry 106. Transistor 102 is electrically coupled between an input node 108 and an output node 110 to form a series-pass element. Output capacitor 104 is electrically coupled between output node 110 and a reference node 112 to help maintain regulation of an output voltage $V_o$ during transient load events. Control circuitry 106 is configured to control transistor 102 to maintain a desired output voltage $V_o$. In particular, control circuitry 106 monitors output voltage $V_o$, and control circuitry 106 drives transistor 102 such that transistor 102 has as requisite voltage drop $V_t$ to achieve the desired output voltage $V_o$. Consequently, control circuitry 106 will vary an operating point of transistor 102 according to operating conditions of linear regulator 100, to maintain regulation of output voltage $V_o$. For example, if magnitude of an input voltage $V_i$ increases, control circuitry 106 will vary the operating point of transistor 102 to increase voltage drop $V_t$, to maintain desired output voltage $V_o$.

DETAILED DESCRIPTION OF THE EMBODIMENTS

Figure 1:
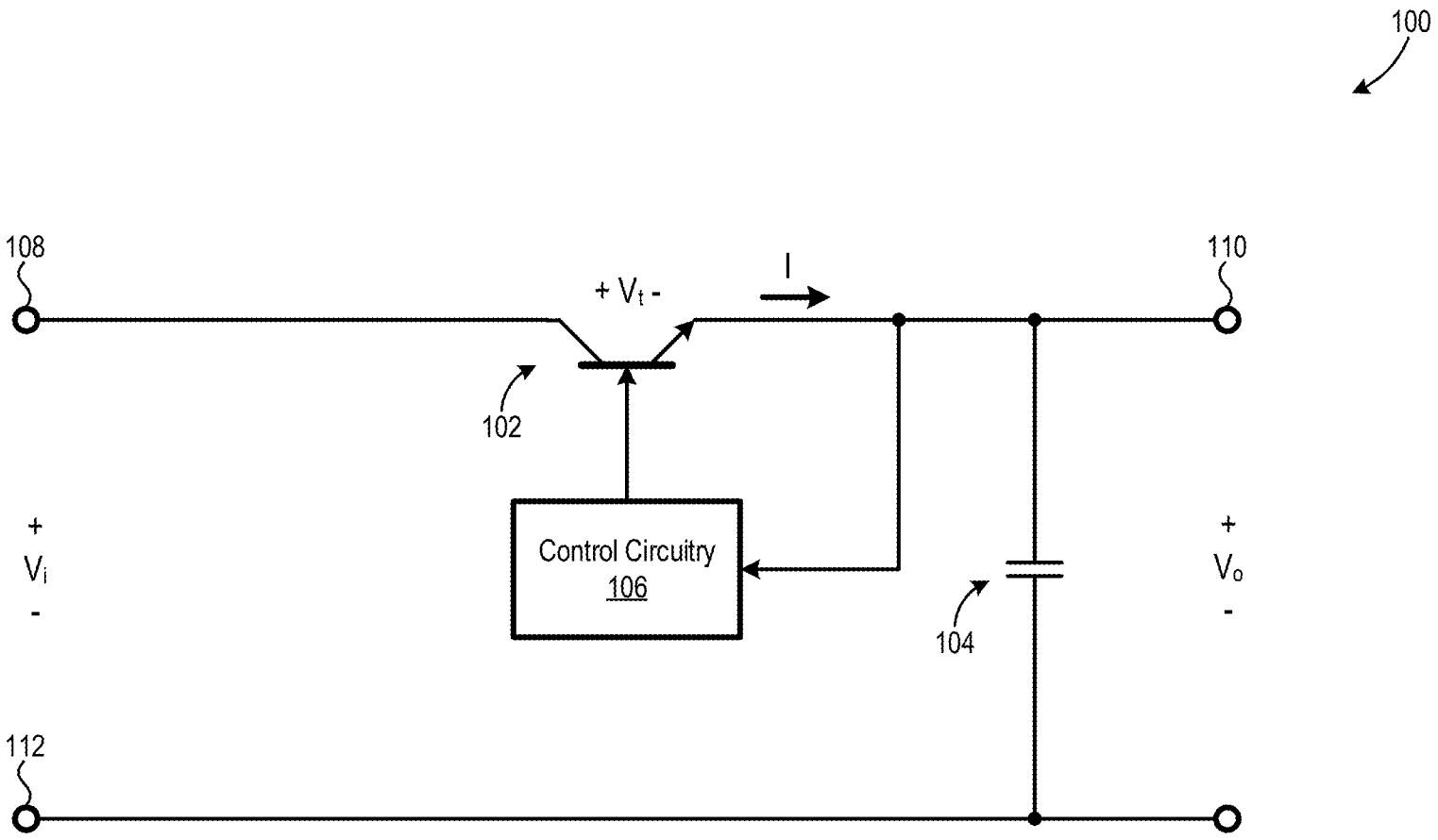
(Prior Art) FIG. 1
FIG. 1 illustrates a conventional linear regulator.
Figure 2:
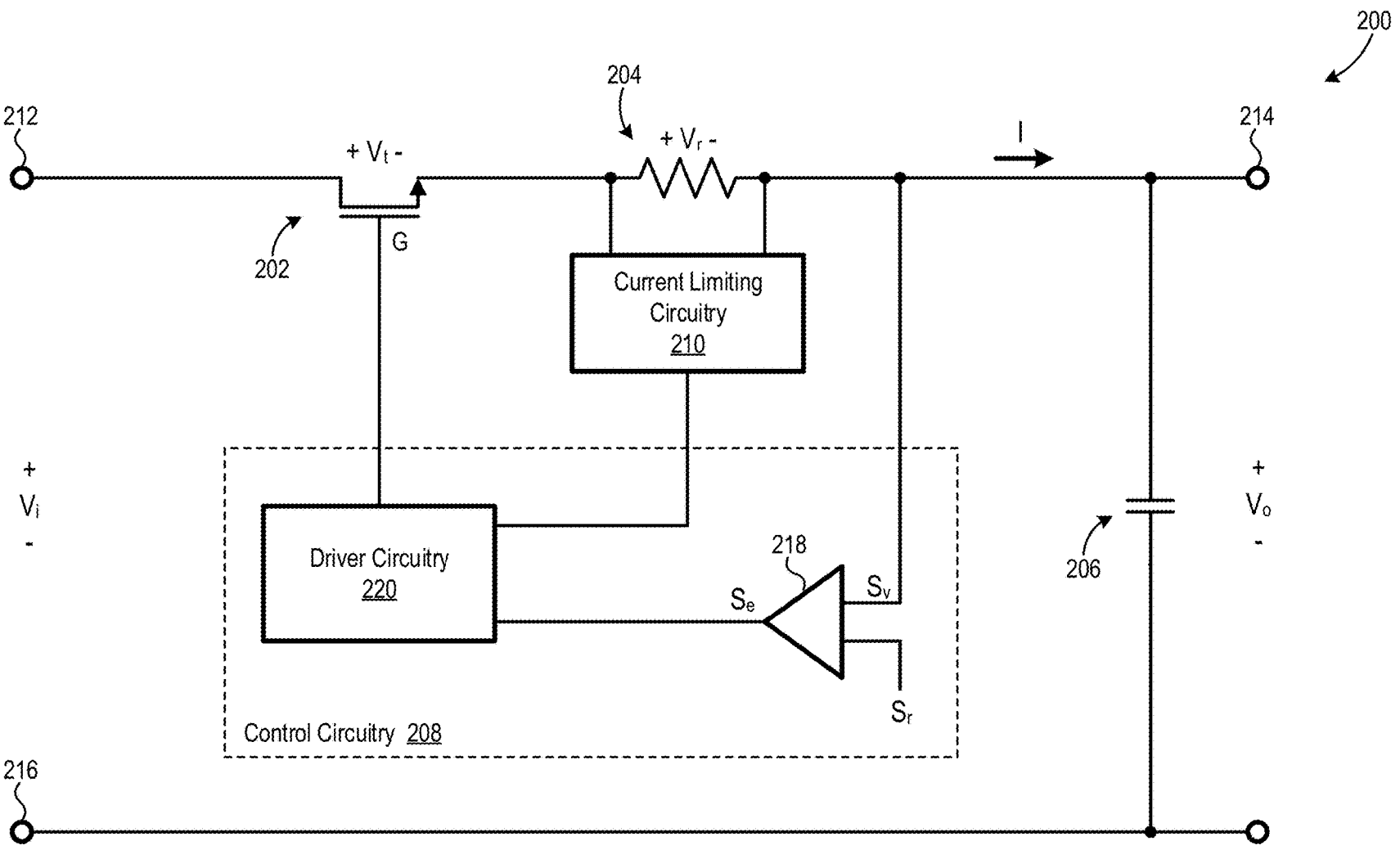
FIG. 2 illustrates a linear regulator configured as a surge stopper.

Although linear regulators can achieve significant advantages, Applicant has found that conventional linear regulators also have significant drawbacks in certain applications. For example, consider a linear regulator 200 of FIG. 2, which is configured as a surge stopper. Linear regulator 200 includes a transistor 202, a current sense resistor 204, an output capacitor 206, control circuitry 208, and current limiting circuitry 210. Transistor 202 is electrically coupled between an input node 212 and an output node 214, and current sense resistor 204 is electrically coupled in series with transistor 202. Output capacitor 206 is electrically coupled between output node 214 and a reference node 216. An electrical power source (not shown) is electrically coupled between input node 212 and reference node 216, and a load (not shown) is electrically coupled between output node 214 and reference node 216.

Control circuitry 208 includes an amplifier 218 and driver circuitry 220. Amplifier 218 is configured to generate an error signal $S_e$ according to a difference between a voltage sense signal $S_v$ and a reference signal $S_r$, where (a) voltage sense signal $S_v$ represents magnitude of an output voltage $V_o$ at output node 214 and (b) reference signal $S_r$ represents a magnitude of a reference voltage. Driver circuitry 220 linearly drives a gate G of transistor 202 according to error signal $S_e$ to achieve a voltage drop $V_t$ across transistor 202 which clamps magnitude of output voltage $V_o$ to a maximum value that is equal to magnitude of the voltage represented by reference signal $S_r$. For example, if magnitude of an input voltage $V_i$ at input node 212 increases beyond magnitude of the voltage represented by reference signal $S_r$, control circuitry 208 drives transistor 202 to increase voltage drop $V_t$ such that magnitude of output voltage $V_o$ does not exceed magnitude of the voltage represented by reference signal $S_r$. As another example, if magnitude of input voltage $V_i$ decreases below magnitude of the voltage represented by reference signal $S_r$, control circuitry 208 drives transistor 202 fully on, i.e. to its most conductive state, to minimize voltage drop $V_t$.

Voltage $V_r$ across current sense resistor 204 is proportional to magnitude of current I, and current limiting circuitry 210 senses voltage $V_r$ to determine magnitude of current I. Current limiting circuitry 210 controls transistor 202 via driver circuitry 220 to limit magnitude of current I to a predetermined maximum value.

Although linear regulator 200 can be effective at stopping surges, it has some significant drawbacks. For example, the small-signal response of linear regulator 200 has a small phase margin at low magnitude of current I, and linear regulator 200 is therefore prone to control loop instability at low magnitude of current I. As another example, output capacitor 206 generates a pole in the small-signal response of linear regulator 200. Consequently, a change in characteristics of output capacitor 206, such as a reduction in equivalent series resistance (ESR) of the capacitor, may degrade control loop stability of linear regulator 200. As a result, a given instance of linear regulator 200 can be used with only a limited range of output capacitors 206. Furthermore, linear regulator 200 suffers from relatively poor transient response under certain conditions.

Applicant has developed linear regulators and associated methods which at least partially overcome one or more of the problems discussed above. These new linear regulators are configured to control a transistor according to at least a current sense signal and a voltage sense signal, which promotes control loop stability and good transient response. Some embodiments are linear voltage regulators that are configured to clamp the magnitude of an output voltage to a maximum value, such that the magnitude of the output voltage decreases with increasing magnitude of current flowing through the transistor.

Figure 3:
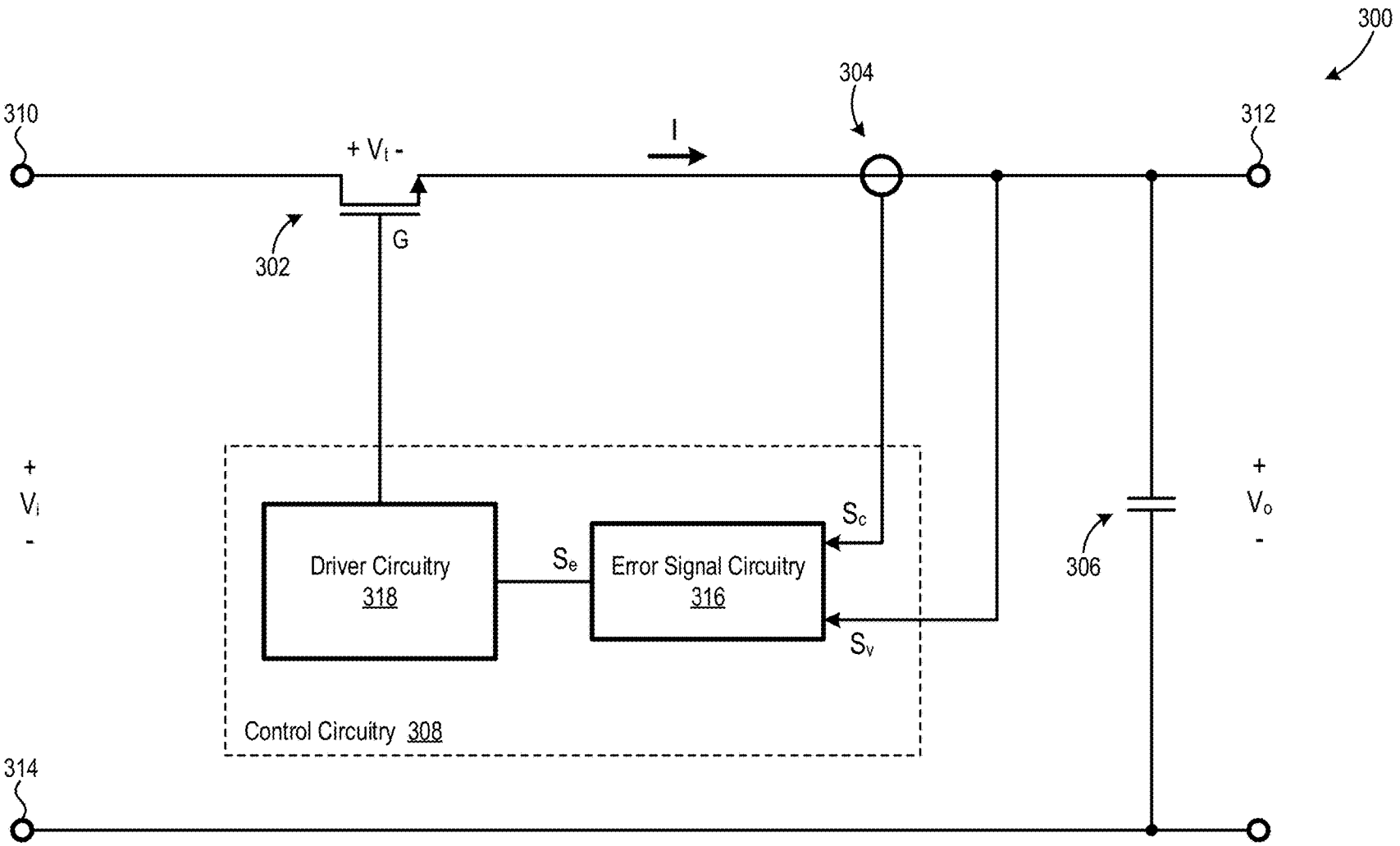
FIG. 3 illustrates a linear regulator configured to control a transistor according to at least a current sense signal and a voltage sense signal, according to an embodiment.

FIG. 3 illustrates a linear regulator 300, which is one embodiment of the new linear regulators developed by Applicant. Linear regulator 300 includes a transistor 302, current sense circuitry 304, an output capacitor 306, and control circuitry 308. Transistor 302 is electrically coupled between an input node 310 and an output node 312, and transistor 302 serves as a series-pass element. Output capacitor 306 is electrically coupled between output node 312 and a reference node 314. An electrical power source (not shown) is electrically coupled between input node 310 and reference node 314, and a load (not shown) is electrically coupled between output node 312 and reference node 314. In some embodiments, the electrical power source and the load are separate from linear regulator 300, while in some other embodiments, one or more of the electrical power source and the load are integrated with linear regulator 300.

Current sense circuitry 304 is configured to generate a current sense signal $S_c$ representing at least magnitude of current I flowing through transistor 302. In some embodiments, current sense signal $S_c$ further represents phase of current I. In certain embodiments, current sense circuitry 304 includes a current sense resistor electrically coupled in series with transistor 302, such as discussed below with respect to FIG. 6. In some other embodiments, current sense circuitry 304 includes a Hall-effect sensor configured to sense current I from a magnetic field generated by current I flowing through an electrical conductor. In yet some other embodiments, current sense circuitry 304 is configured to generate current sense signal $S_c$ from a signal flowing through one or more replica transistors electrically coupled to transistor 302. Furthermore, current sense circuitry 304 can be implemented in other manners without departing from the scope hereof. Moreover, the location of current sense circuitry 304 in linear regulator 300 can be varied, such as discussed below with respect to FIG. 10.

In particular embodiments, current sense circuitry 304 is configured to generate current sense signal $S_c$ such that current sense signal $S_c$ is a linear function of magnitude of current I, while in some other embodiments, current sense circuitry 304 is configured to generate current sense signal $S_c$ such that current sense signal $S_c$ is a non-linear function of magnitude of current I. Additionally, in some embodiments, current sense circuitry 304 is configured to generate current sense signal $S_c$ such that current sense signal $S_c$ is solely a function of a direct current (DC) component of current I, while in some other embodiments, current sense circuitry 304 is configured to generate current sense signal $S_c$ such that current sense signal $S_c$ is solely a function of an alternating current (AC) component of current I. In yet some other embodiments, current sense circuitry 304 is configured to generate current sense signal $S_c$ such that current sense signal $S_c$ is a function of both DC and AC components of current I. As discussed below, the relationship between current sense signal $S_c$ and magnitude of current I affects a relationship between magnitude of an output voltage $V_o$ and magnitude of current I, where output voltage $V_o$ is voltage at output node 312, e.g., electrical potential difference between output node 312 and reference node 314.

Control circuitry 308 is configured to control transistor 302 according to at least (a) current sense signal $S_c$ and (b) a voltage sense signal $S_v$ representing output voltage $V_o$. Control circuitry 308 includes error signal circuitry 316 and driver circuitry 318. Error signal circuitry 316 is configured to generate an error signal $S_e$ according to at least current sense signal $S_c$ and voltage sense signal $S_v$. In certain embodiments, voltage sense signal $S_v$ is directly taken from output voltage node 312, such as illustrated in FIG. 3, so that voltage sense signal $S_v$ is the same as output voltage $V_o$. In some other embodiments, voltage sense signal $S_v$ is derived from output voltage node 312 such that voltage sense signal $S_v$ is proportional to output voltage $V_o$.

Driver circuitry 318 linearly drives a gate G of transistor 302, such as by linearly varying voltage at gate G, according to error signal $S_e$. For example, in some embodiments, driver circuitry 318 is configured to linearly drive gate G of transistor 302 according to error signal $S_e$ to regulate magnitude of output voltage $V_o$. As another example, in some other embodiments, driver circuitry 318 is configured to linearly drive gate G of transistor 302 according to error signal $S_e$ such that linear regulator 300 acts as a surge stopper, or in other words, such that linear regulator 300 helps prevent a surge in an input voltage $V_i$ at input node 310 from reaching output node 312.

Figure 4:
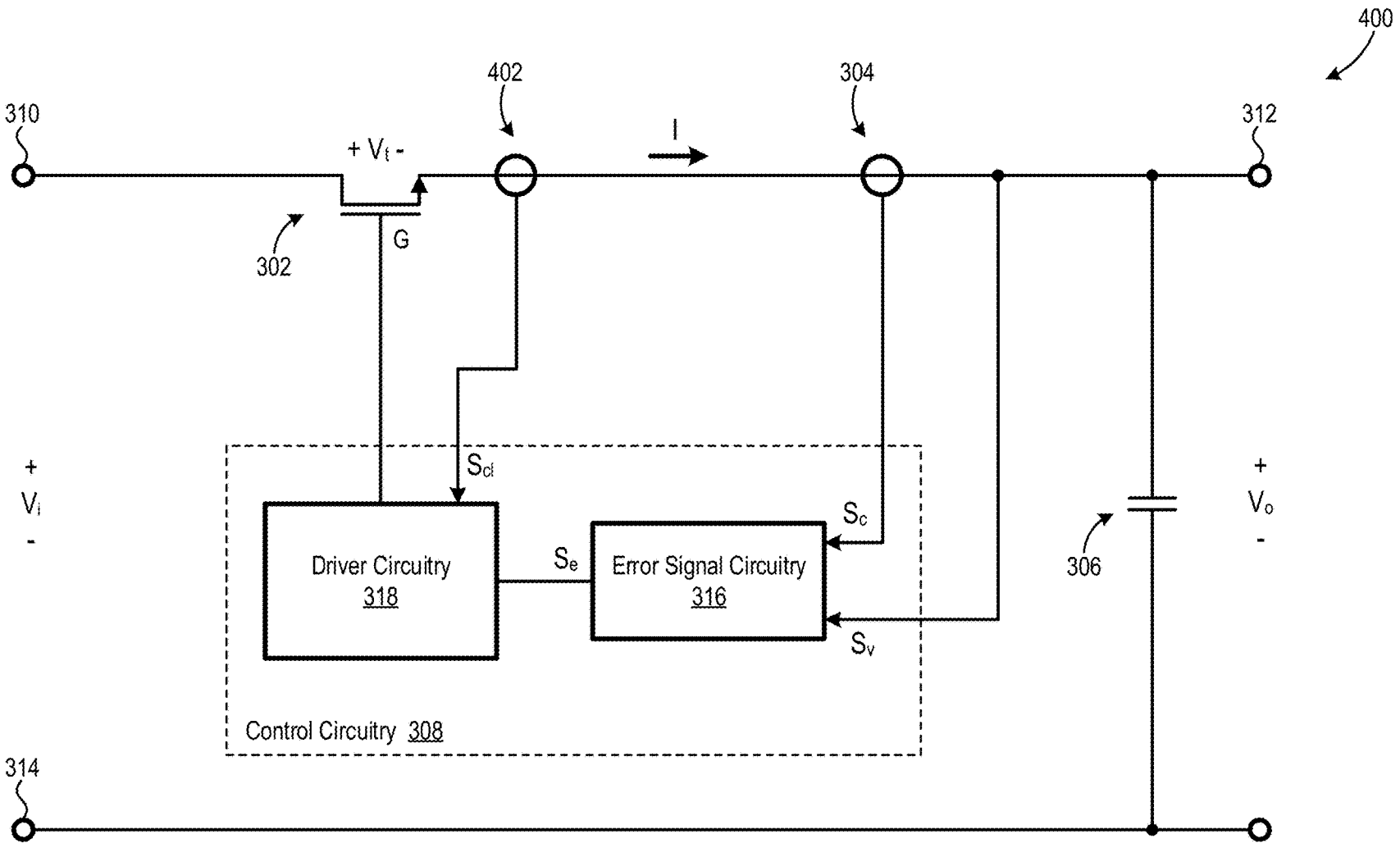
FIG. 4 illustrates a linear regulator which is like the FIG. 3 linear regulator but further including current limiting circuitry, according to an embodiment.

Linear regulator 300 could be modified to have additional functionality. For example, FIG. 4 illustrates a linear regulator 400, which is like linear regulator 300 of FIG. 3 but further including current limiting circuitry 402. Current limiting circuitry 402 is configured to cooperate with control circuitry 308 to limit magnitude of current I, such as to a predetermined maximum value. For example, in a particular embodiment, current limiting circuitry 402 is configured to sense magnitude of current I and generate a signal $S_{cl}$ in response to magnitude of current I exceeding a threshold value. Driver circuitry 318 linearly controls transistor 302, such as by varying voltage at gate G, to limit magnitude of current I to the predetermined maximum value in response to signal $S_{cl}$. Although current limiting circuitry 402 is illustrated as being separate from current sense circuitry 304, in some embodiments, current sense circuitry 304 and current limiting circuitry 402 share one or more elements, such as a common current sensing element.

FIGS. 5-9 illustrate several examples of how control circuitry 308 and current sense circuitry 304 could be configured in linear regulators 300 and 400. It should be appreciated, however, that linear regulators 300 and 400 is not limited to the configurations discussed below.

Figure 5:
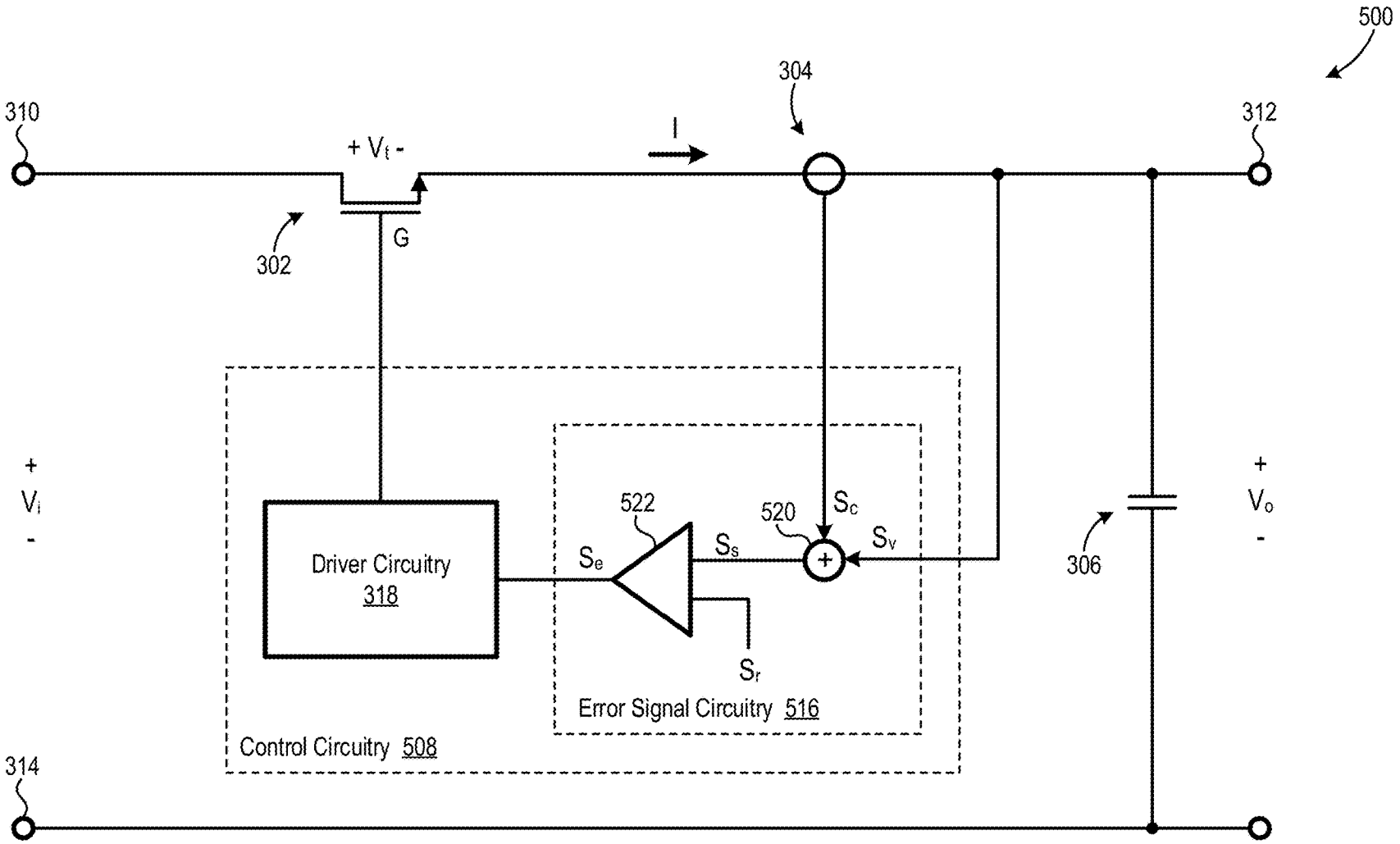
FIG. 5 illustrates an embodiment of the FIG. 3 linear regulator configured to control a transistor according to a sum of a current sense signal and a voltage sense signal.

FIG. 5 illustrates a linear regulator 500, which is an embodiment of linear regulator 300 configured to control transistor 302 according to a sum of current sense signal $S_c$ and voltage sense signal $S_v$. Control circuitry 308 is embodied in linear regulator 500 as control circuitry 508, which includes error signal circuitry 516 and driver circuitry 318. Error signal circuitry 516 is an embodiment of error signal circuitry 316 and includes a summation device 520 and an amplifier 522. Summation device 520 is configured to sum current sense signal $S_c$ and voltage sense signal $S_v$ to generate a feedback sum signal $S_s$. Amplifier 522 is configured to generate an error signal $S_e$ according to a difference between feedback sum signal $S_s$ and a reference signal $S_r$, where reference signal $S_r$ represents a magnitude of a reference voltage. Stated differently, amplifier 522 amplifies a difference between feedback sum signal $S_s$ and reference signal $S_r$ to generate error signal $S_e$. Driver circuitry 318 linearly drives gate G of transistor 302 according to error signal $S_e$, as discussed above with respect to FIG. 3.

Discussed below are four examples of how control circuitry 508 and current sense circuitry 304 could be configured in linear regulator 500. In the embodiments of Examples A and B, linear regulator 500 is configured as a voltage regulator, and in examples C and D, linear regulator 500 is configured as a surge stopper. It should be appreciated, however, that linear regulator 500 is not limited to the configurations discussed below.

Example A

In this example embodiment of linear regulator 500, control circuitry 508 is configured to regulate magnitude of output voltage $V_o$ according to EQN. 1 below, and current sense circuitry 304 is configured to have a linear gain m defined by EQN. 2 below. $V_{ref}$ of EQN. 1 is magnitude of the reference voltage represented by reference signal $S_r$, and n of EQN. 1 is a constant defined by EQN. 3 below.

$$V_o = \frac{V_{ref}}{n} - mI \quad \text{(EQN. 1)}$$

$$m = \frac{S_c}{I} \quad \text{(EQN. 2)}$$

$$n = \frac{S_v}{V_o} \quad \text{(EQN. 3)}$$

Figure 6:
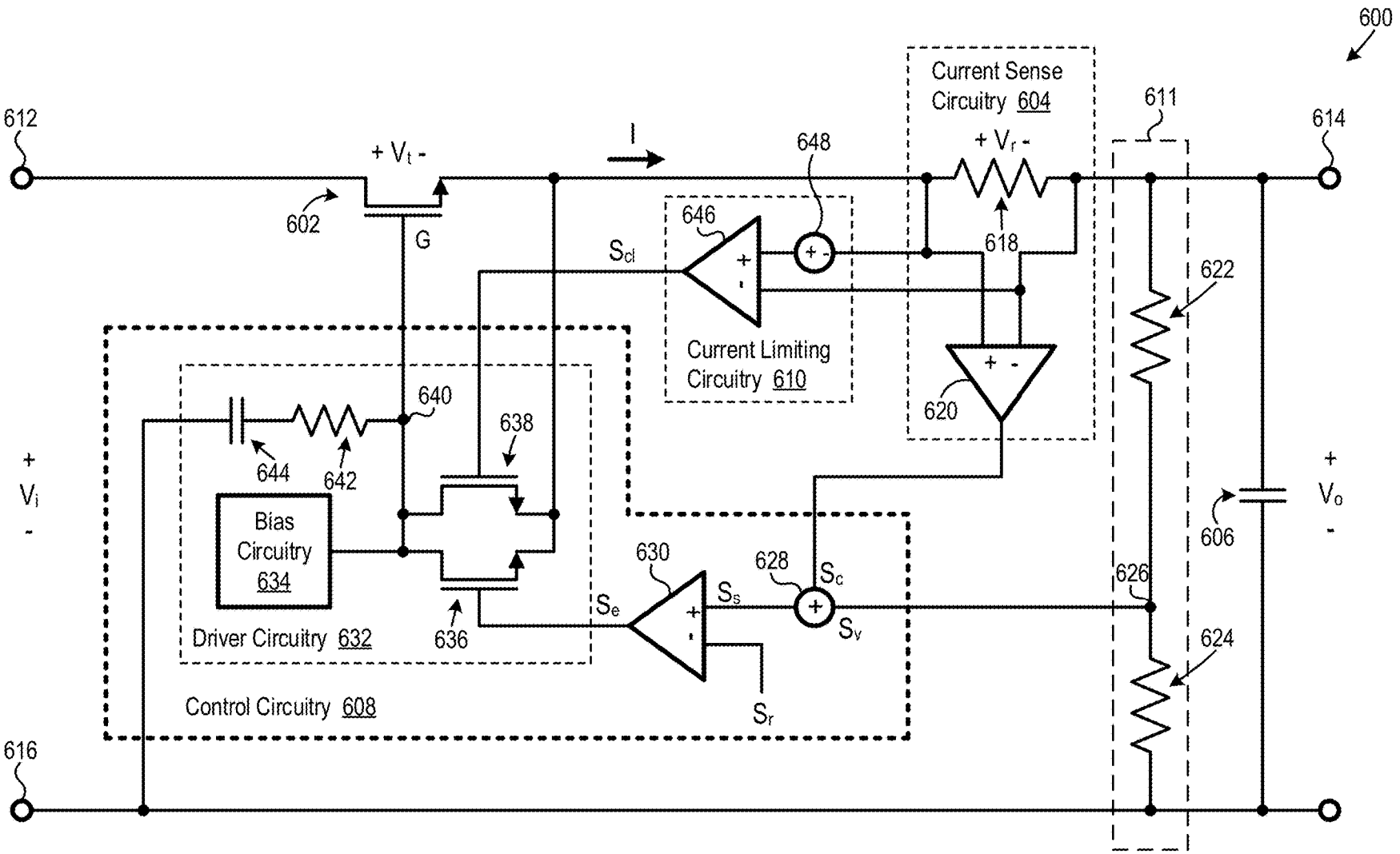
FIG. 6 illustrates an embodiment of the FIG. 5 linear regulator.

As evident from EQN. 3, n is the relationship between output voltage $V_o$ and voltage sense signal $S_v$. Consequently, in embodiments where voltage sense signal $S_v$ is directly taken from output voltage node 312, such as illustrated in FIG. 5, n is equal to one. In embodiments where voltage sense signal $S_v$ is derived from output voltage $V_o$, such as illustrated in FIG. 6, n may be a number other than one. As evident from EQN. 1, output voltage $V_o$ linearly decreases in proportion to magnitude of current I, such that linear regulator 500 has a non-zero effective output impedance, which is sometimes referred to as a "load line."

Example B

In this example embodiment of linear regulator 500, control circuitry 508 is configured to regulate magnitude of output voltage $V_o$ according to EQN. 4 below. Current sense circuitry 304 is configured to have a non-linear gain m(i) as defined by EQN. 5 below, where i ranges from zero to a maximum value of current I.

$$V_o = \frac{V_{ref}}{n} - m(i)I(i) \quad \text{(EQN. 4)}$$

$$m(i) = \frac{S_c}{I(i)} \quad \text{(EQN. 5)}$$

In particular embodiments, non-linear gain m(i) is larger at lower magnitudes of current I than at larger magnitudes of current I, to promote control loop stability under light-load conditions.

Example C

In this embodiment of linear regulator 500, control circuitry 508 is configured to clamp output voltage $V_o$ to a maximum value $V_{o_max}$ defined by EQN. 6 below, where $V_{ref}$, m, and n are the same as discussed above with respect to Example A. Thus, output voltage $V_o$ is clamped to a maximum value that is a linear function of current I, in this embodiment.

$$V_{o_max} = \frac{V_{ref}}{n} = mI \quad \text{(EQN. 6)}$$

Example D

In this embodiment of linear regulator 500, control circuitry 508 is configured to clamp output voltage $V_o$ to a maximum value $V_{o_max}$ defined by EQN. 7 below, where $V_{ref}$, m(i), and n are the same as discussed above with respect to Example B. Thus, output voltage $V_o$ is clamped to a maximum value that is a non-linear function of current I, in this embodiment.

$$V_{o_max} = \frac{V_{ref}}{n} - m(i)I(i) \quad \text{(EQN. 7)}$$

FIG. 6 illustrates a linear regulator 600, which is one embodiment of linear regulator 500 that is configured as a surge stopper and includes current limiting circuitry. Linear regulator 600 includes a transistor 602, current sense circuitry 604, an output capacitor 606, control circuitry 608, and current limiting circuitry 610, which are embodiments of transistor 302, current sense circuitry 304, output capacitor 306, control circuitry 508, and current limiting circuitry 402, respectively. Transistor 602 is electrically coupled between an input node 612 and an output node 614, and output capacitor 606 is electrically coupled between output node 614 and a reference node 616. Linear regulator 600 further includes a voltage divider 611 electrically coupled between output node 614 and reference node 616. An electrical power source (not shown) is electrically coupled between input node 612 and reference node 616, and a load (not shown) is electrically coupled between output node 614 and reference node 616. In some embodiments, the electrical power source and the load are separate from linear regulator 600, while in some other embodiments, one or more of the electrical power source and the load are integrated with linear regulator 600.

Figure 17:
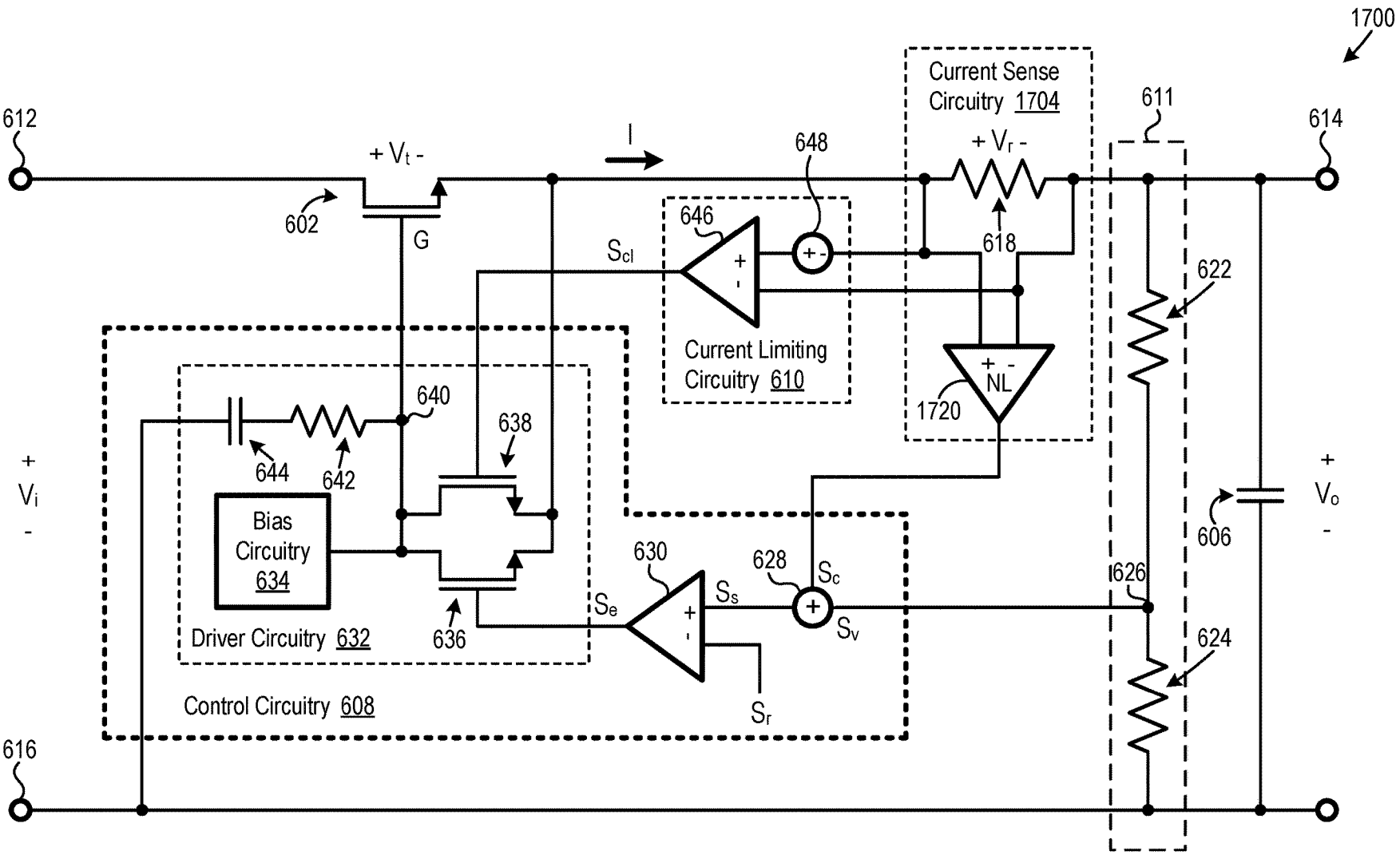
FIG. 17 illustrates an embodiment of the FIG. 6 linear regulator including a non-linear amplifier.

Current sense circuitry 604 includes a current sense resistor 618 and an amplifier 620. Current sense resistor 618 is electrically coupled in series with transistor 602, and current sense resistor 618 generates a voltage $V_r$ that is proportional to magnitude of current I. Amplifier 620 amplifies voltage $V_r$ across current sense resistor 618 to generate a current sense signal $S_c$ representing magnitude of current I flowing through transistor 602. In some embodiments, amplifier 620 is configured such that current sense signal $S_c$ is a linear function of magnitude of current I, while in some other embodiments, amplifier 620 is configured such that current sense signal $S_c$ is a non-linear function of magnitude of current I. For example, FIG. 17 illustrates a linear regulator 1700, which is one embodiment of linear regulator 600 where current sense circuitry 604 is embodied by current sense circuitry 1704 including a non-linear (NL) amplifier 1720.

Voltage divider 611 is configured to derive voltage sense signal $S_v$ from an output voltage $V_o$, where output voltage $V_o$ is voltage at output node 614, e.g., electrical potential difference between output node 614 and reference node 616. Voltage divider 611 includes a first resistor 622 and a second resistor 624 electrically coupled in series between output node 614 and reference node 616. Voltage divider 611 generates a voltage sense signal $S_v$ at a node 626 between first resistor 622 and second resistor 624. Voltage sense signal $S_v$ represents output voltage $V_o$. Voltage sense signal $S_v$ is related to output voltage $V_o$ according to EQN. 3 above, where n is defined according to EQN. 8 below, assuming negligible current flows from node 626 to control circuitry 608. $R_{622}$ and $R_{624}$ in EQN. 8 are resistances of resistors 622 and 624, respectively.

$$n = \frac{R_{624}}{R_{622} + R_{624}} \quad \text{(EQN. 8)}$$

Control circuitry 608 is configured to control transistor 602 according to a sum of current sense signal $S_c$ and voltage sense signal $S_v$. In particular, control circuitry 608 includes a summation device 628, an amplifier 630, and driver circuitry 632 which are embodiments of summation device 520, amplifier 522, and driver circuitry 318, respectively. Summation device 628 is configured to sum current sense signal $S_c$ and voltage sense signal $S_v$ to generate a feedback sum signal $S_s$. Amplifier 630 is configured to generate an error signal $S_e$ according to a difference between feedback sum signal $S_s$ and a reference signal $S_r$, where reference signal $S_r$ represents a magnitude of a reference voltage.

Driver circuitry 632 linearly drives a gate G of transistor 602, such as by linearly varying voltage at gate G, according to error signal $S_e$. In particular, driver circuitry 632 includes bias circuitry 634, a first modulation transistor 636, and a second modulation transistor 638. Bias circuitry 634 is configured to electrically bias gate G of transistor 602, such that transistor 602 operates in its conductive state absent effects of first and second modulation transistors 636 and 638. In some embodiments, bias circuitry 634 includes charge pump circuitry to charge capacitance at a node 640 electrically coupled to gate G. First modulation transistor 636 is configured to linearly modulate voltage at gate G according to according to error signal $S_e$. In some embodiments, control circuitry 608 is configured to clamp output voltage $V_o$ according to EQN. 6 or 7 above, depending on whether current sense signal $S_c$ is a linear or non-linear function of magnitude of current I, respectively, such that linear regulator 600 is configured as a surge stopper. Second modulation transistor 638 is used for current limiting as discussed below. In certain alternate embodiments, first and second modulation transistors 636 and 638 are replaced with a common transistor driven by each of amplifier 630 and current limiting circuitry 610.

Driver circuitry 632 optionally further includes a resistor 642 and a capacitor 644 electrically coupled in series between gate G and reference node 616. Resistor 642 and capacitor 644 enable adjustment of a small-signal pole associated with transistor 602, to adjust the small-signal response of linear regulator 600.

Current limiting circuitry 610 cooperates with control circuitry 608 to limit magnitude of current I, such as to a predetermined maximum value. In particular, current limiting circuitry 610 includes an amplifier 646 and a threshold voltage reference 648. Inputs of amplifier 646 are electrically coupled across current sense resistor 618, with voltage reference 648 electrically coupled in series with the non-inverting input of amplifier 646. Thus, current sense circuitry 604 and current limiting circuitry 610 share current sense resistor 618. In response to voltage $V_r$ across current sense resistor 618 exceeding a voltage of threshold voltage reference 648, current limiting circuitry 610 generates a signal $S_{cl}$. Signal $S_{cl}$ drives second modulation transistor 638 to modulate gate G of transistor 602, thereby limiting magnitude of current I to a value set by voltage of threshold voltage reference 648.

The configuration of control circuitry 608 could be modified without departing from the scope hereof. For example, driver circuitry 632 could be replaced with alternative circuitry to bias gate G according to error signal $S_e$. As another example, one or more components of control circuitry 608 could be combined, and/or one or more components of control circuitry 608 could be split into two or more components. As yet another example, control circuitry 608 could alternately be partially or fully implemented by a processor and interface circuitry electrically coupling the processor to other components of linear regulator 600, where the processor executes instructions in the form of software or firmware stored in a memory to perform the functions of control circuitry 608.

Figure 7:
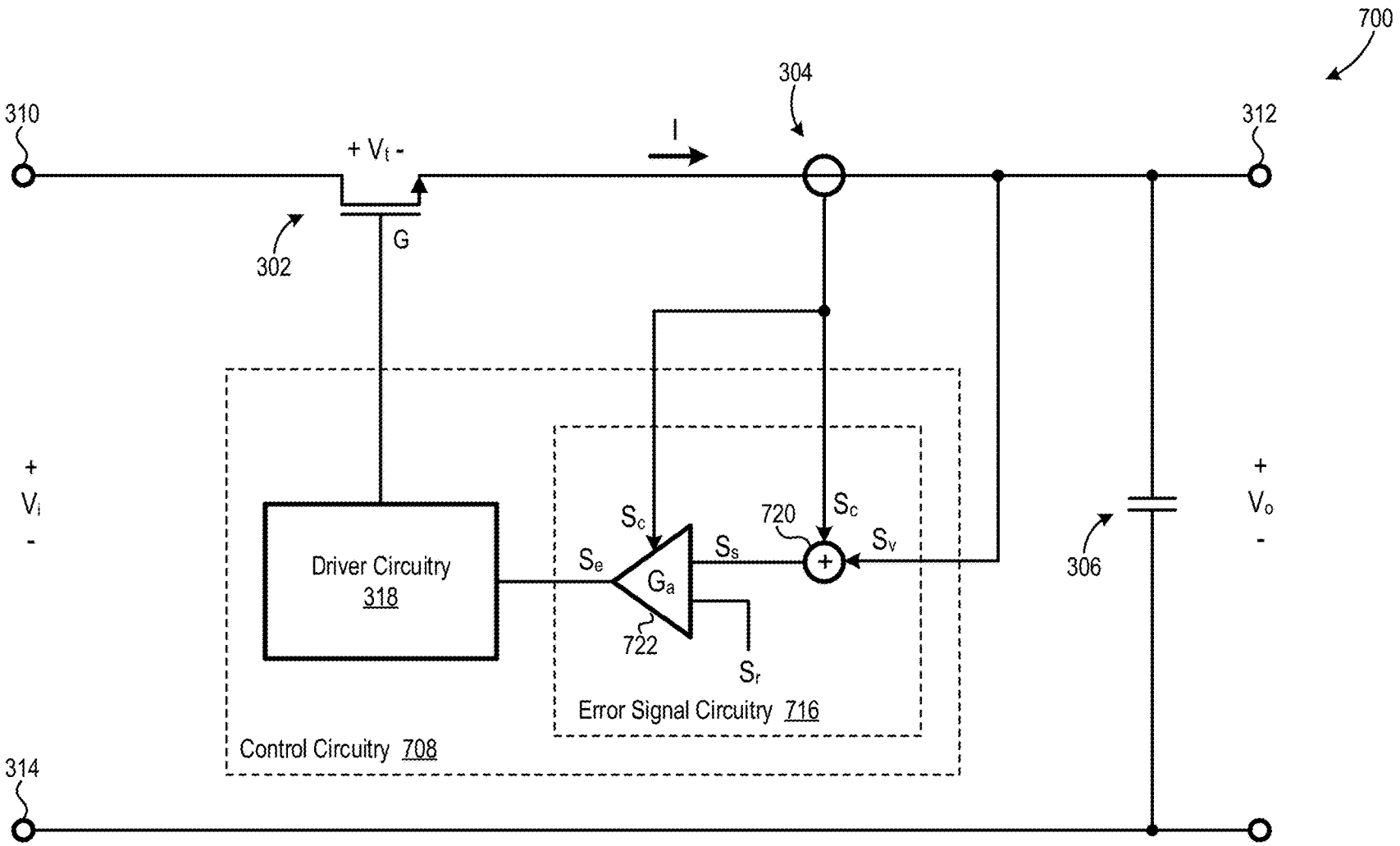
FIG. 7 illustrates an embodiment of the FIG. 3 linear regulator configured to modulate an error signal according to a current sense signal.

FIG. 7 illustrates a linear regulator 700, which is another embodiment of linear regulator 300 configured to control transistor 302 according to a sum of current sense signal $S_c$ and voltage sense signal $S_v$. Control circuitry 308 is embodied in linear regulator 700 as control circuitry 708, which includes error signal circuitry 716 and driver circuitry 318. Error signal circuitry 716 is an embodiment of error signal circuitry 316 and includes a summation device 720 and an amplifier 722. Summation device 720 is configured to sum current sense signal $S_c$ and voltage sense signal $S_v$ to generate a feedback sum signal $S_s$. Amplifier 722 is configured to generate an error signal $S_e$ according to a difference between feedback sum signal $S_s$ and a reference signal $S_r$, where reference signal $S_r$ represents a magnitude of a reference voltage. Amplifier 722 has a gain $G_a$ defined according to EQN. 9 below, where A is a base gain of amplifier 722 and $\alpha$ is a constant.

$$G_a=(A+\alpha S_c) \quad \text{(EQN. 9)}$$

Thus, gain $G_a$ is proportional current sense signal $S_c$ in linear regulator 700, such that error signal $S_e$ is modulated according to current sense signal $S_c$. As discussed above, current sense signal $S_c$ may be either linearly or non-linear proportional to magnitude of current I, depending on the configuration of current sense circuitry 304. Thus, gain $G_a$ is either linearly or non-linear proportional to magnitude of current I, depending on the configuration of current sense circuitry 304. Driver circuitry 318 linearly drives gate G of transistor 302 according to error signal $S_e$, as discussed above with respect to FIG. 3. In certain embodiments, linear regulator 700 is configured as a voltage regulator or surge stopper, such as in a manner similar to that discussed above with respect to Examples A-D. In one particular embodiment, linear regulator 700 is implemented like linear regulator 600 of FIG. 6 but with amplifier 630 replaced with an amplifier having a gain defined by EQN. 9 above.

Figure 8:
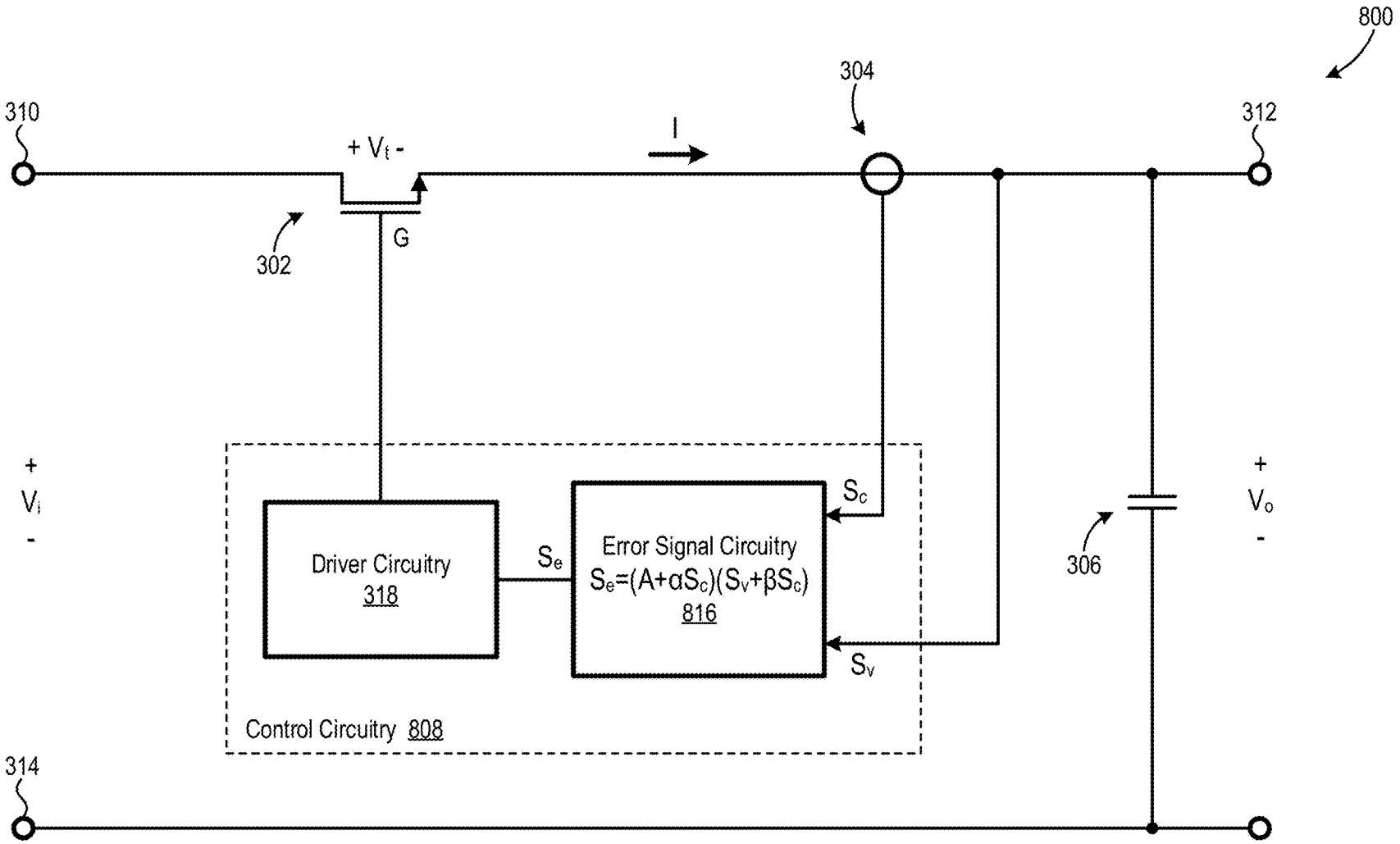
FIG. 8 illustrates another embodiment of the FIG. 3 linear regulator configured to modulate an error signal according to a current sense signal.

FIG. 8 illustrates a linear regulator 800, which is another embodiment of linear regulator 300 configured to modulate error signal $S_e$ according to current sense signal $S_c$. Control circuitry 308 is embodied in linear regulator 800 as control circuitry 808, which includes error signal circuitry 816 and driver circuitry 318. Error signal circuitry 816 is an embodiment of error signal circuitry 316 and is configured to generate an error signal $S_e$ according to the following equation, where each of A, α, and β is a constant:

$$S_e=(A+\alpha S_C)(S_V+\beta S_c) \quad \text{(EQN. 10)}$$

As can be determined from EQN. 10, error signal $S_e$ is modulated according to current sense signal $S_c$ in linear regulator 800. In one particular embodiment, linear regulator 800 is implemented like linear regulator 600 of FIG. 6 but with amplifier 630 and summation device 628 replaced with circuitry configured to implement EQN. 10. Driver circuitry 318 linearly drives gate G of transistor 302 according to error signal $S_e$, as discussed above with respect to FIG. 3.

Figure 9:
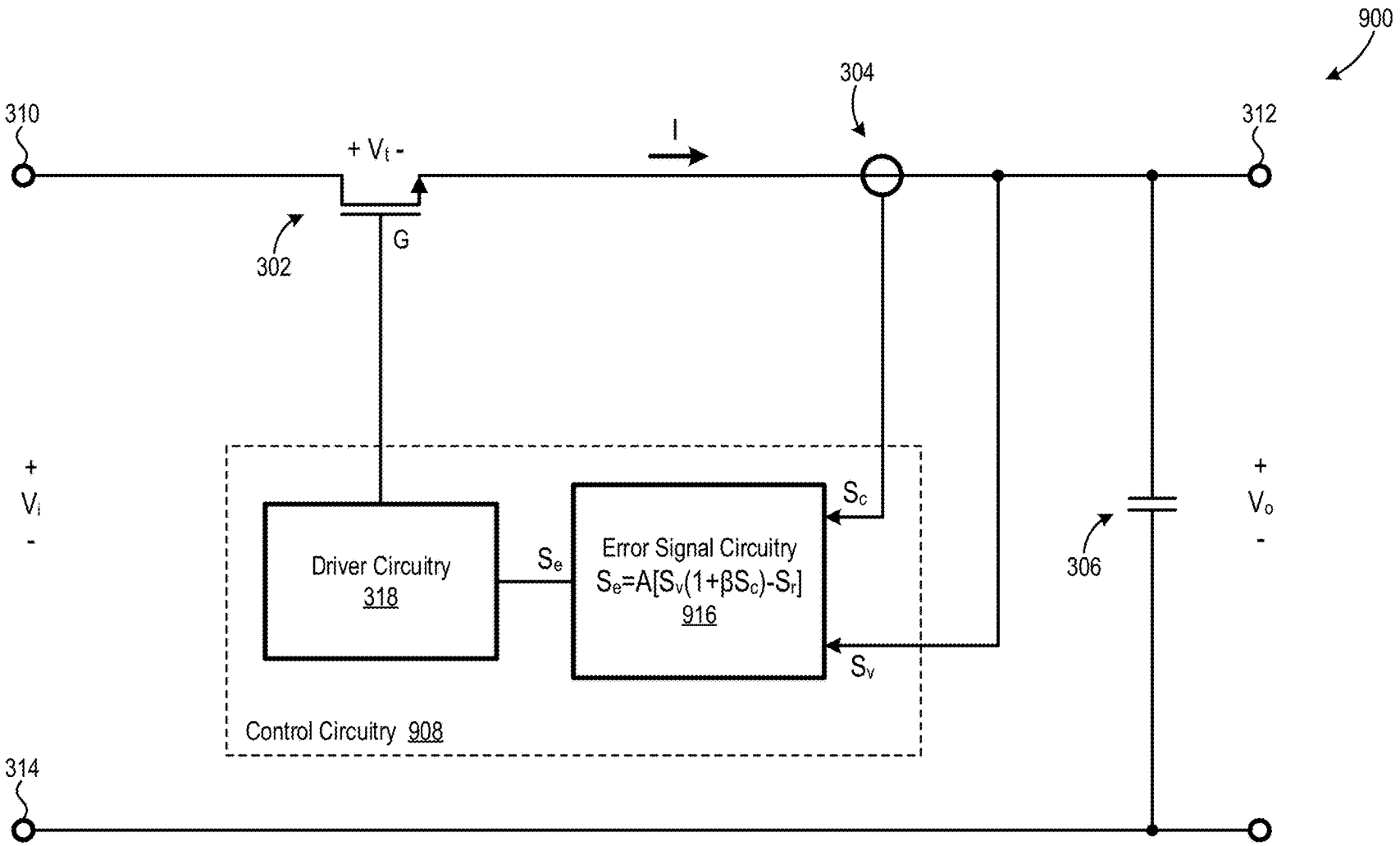
FIG. 9 illustrates yet another embodiment of the FIG. 3 linear regulator.

FIG. 9 illustrates a linear regulator 900, which is yet another embodiment of linear regulator 300. Control circuitry 308 is embodied in linear regulator 900 as control circuitry 908, which includes error signal circuitry 916 and driver circuitry 318. Error signal circuitry 916 is an embodiment of error signal circuitry 316 and is configured to generate an error signal $S_e$ according to EQN. 11 below, where each of A and β is a constant and $S_r$ is a reference signal. In one particular embodiment, linear regulator 900 is implemented like linear regulator 600 of FIG. 6 but with amplifier 630 and summation device 628 replaced with circuitry configured to implement EQN. 11. Driver circuitry 318 linearly drives gate G of transistor 302 according to error signal $S_e$, as discussed above with respect to FIG. 3.

$$S_e=A[S_v(1+\beta S_c)-S_r] \quad \text{(EQN. 11)}$$

Figure 10:
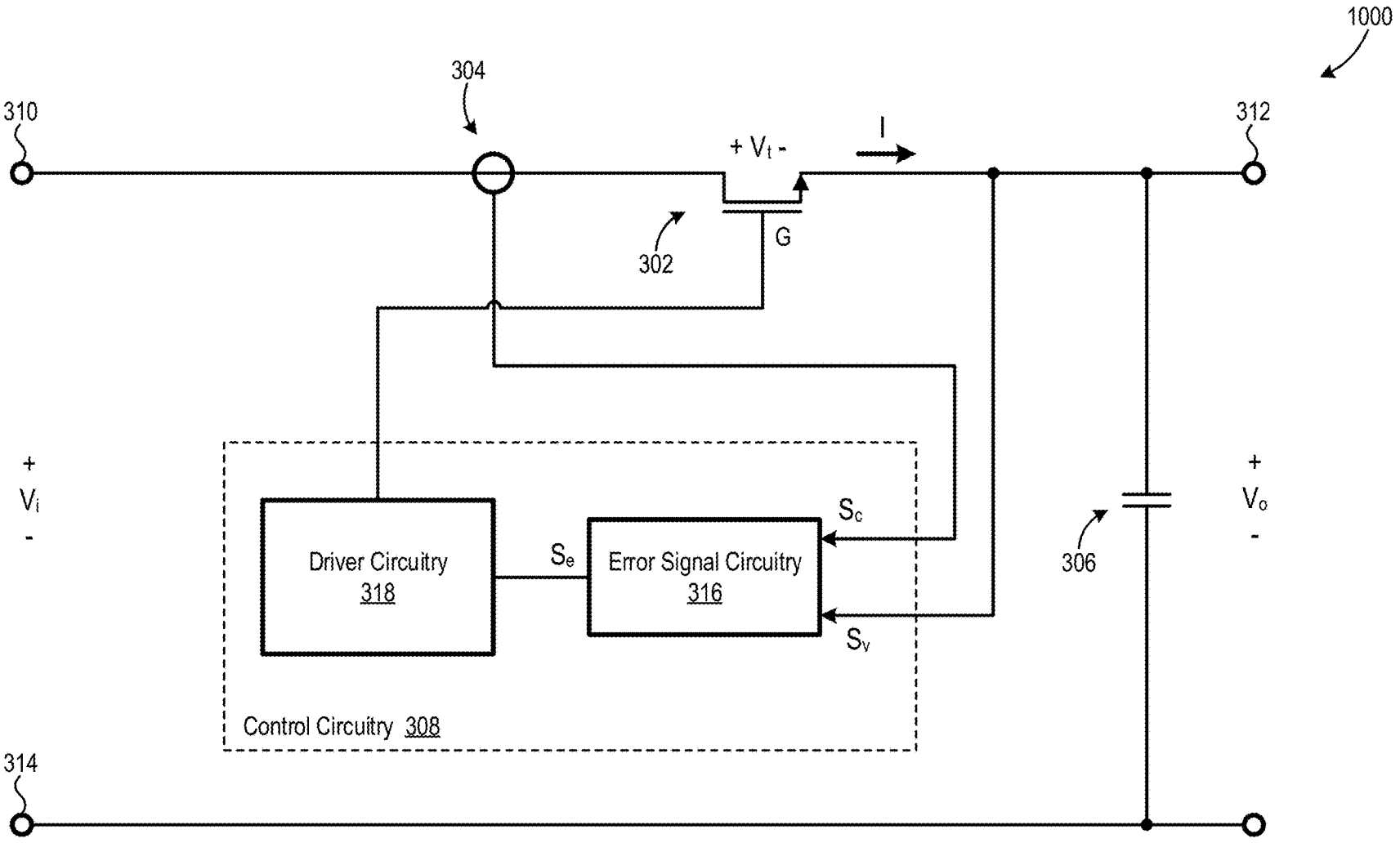
FIG. 10 illustrates a linear regulator which is like the FIG. 3 linear regulator but with locations of a transistor and current sense circuitry swapped, according to an embodiment.
Figure 11:
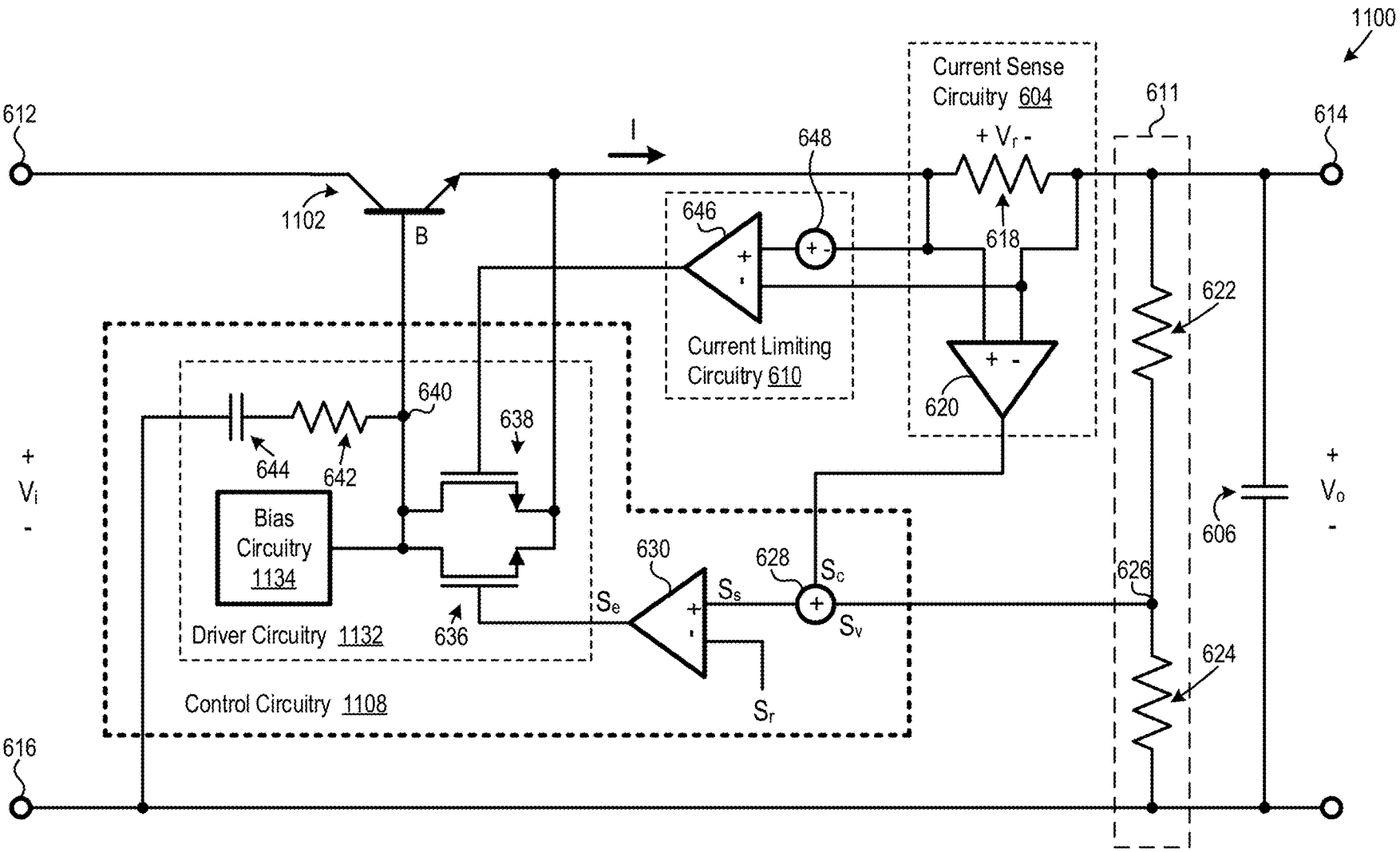
FIG. 11 illustrates a linear regulator which is like the FIG. 6 linear regulator but with a different transistor and different control circuitry, according to an embodiment.

The locations of the series-pass transistor and the current sense circuitry could be varied without departing from the scope hereof. For example, FIG. 10 illustrates a linear regulator 1000 which is like linear regulator 300 of FIG. 3 but with the locations of transistor 302 and current sense circuitry 304 swapped. Additionally, although the linear regulators are illustrated herein with transistors 302 and 602 being N-channel, enhancement-mode metal oxide semiconductor field effect transistors (MOSFETs), the transistors could be replaced with another type of transistor, with appropriate changes to driver circuitry 318 and 632. For example, FIG. 11 illustrates a linear regulator 1100 which is like linear regulator 600 of FIG. 6 but with (a) transistor 602 replaced with a bipolar junction transistor (BJT) 1102, and (b) control circuitry 608 replaced with control circuitry 1108. Control circuitry 1108 includes driver circuitry 1132 with bias circuitry 1134 configured to provide current to a base B of BJT 1102, and first modulation transistor 636 is configured to modulate current to base B according to according to error signal $S_e$. Additionally, transistors 302, 602, and 1102 could be supplemented with one or more additional transistors electrically coupled in parallel and/or series.

Figure 12:
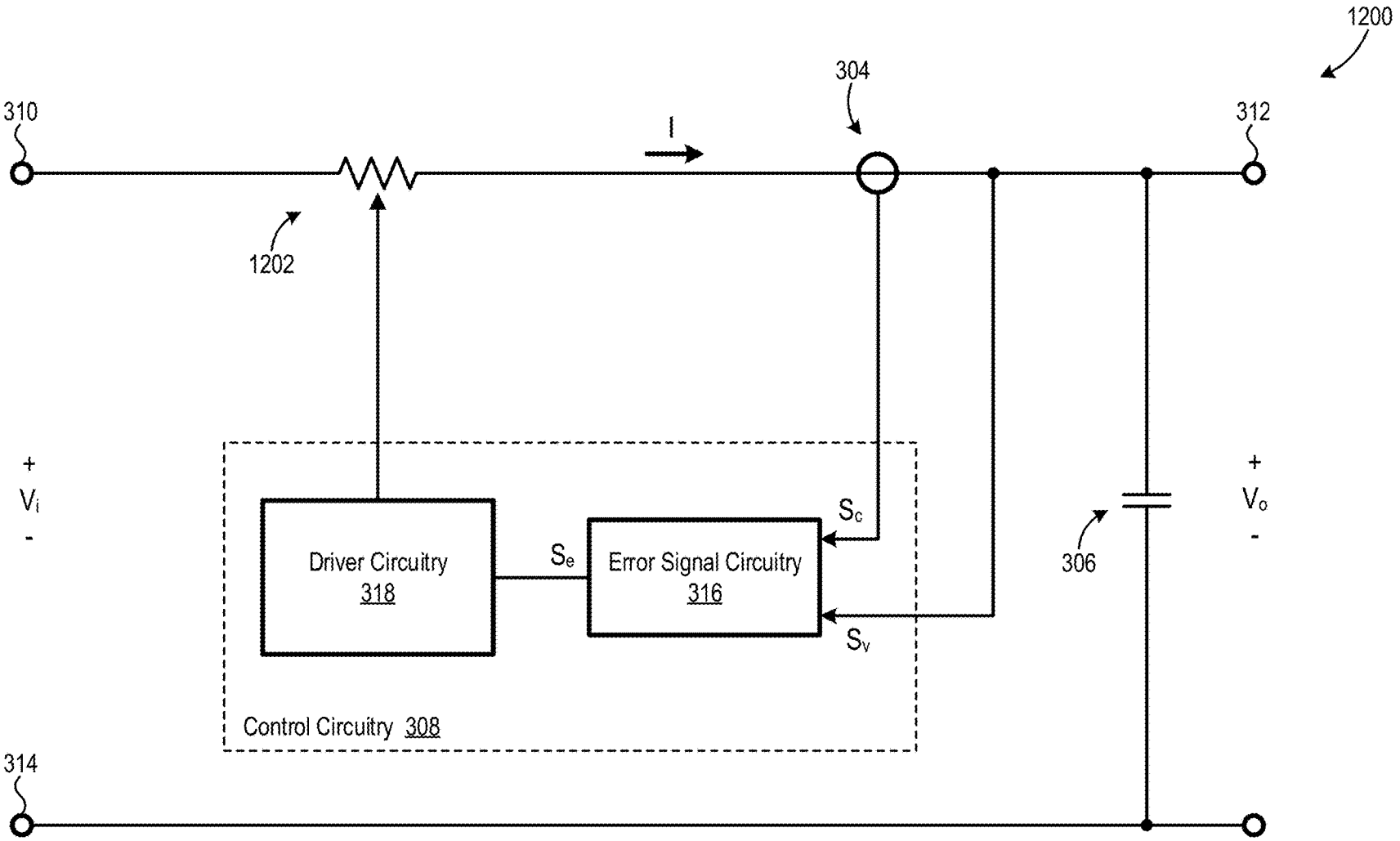
FIG. 12 illustrates a linear regulator which is like the FIG. 3 linear regulator but with a programmable resistor as a series-pass element, according to an embodiment.

Furthermore, although the series-pass element is a transistor in the linear regulators discussed above, any of the linear regulators disclosed herein could be modified to use a different type of series-pass element in place of a transistor. Examples of possible alternative series-pass elements include, but are not limited to, a programmable resistor, a potentiometer that is adjustable via a control signal, and a vacuum tube. For example, FIG. 12 illustrates a linear regulator 1200 which is like linear regulator 300 of FIG. 3 but with transistor 302 replaced with a programmable resistor 1202. Programmable resistor 1202 serves as a series-pass element, and driver circuitry 318 controls resistance of programmable resistor 1202 according to error signal $S_e$ in a matter analogous to that discussed above with respect to FIG. 3.

Figure 13:
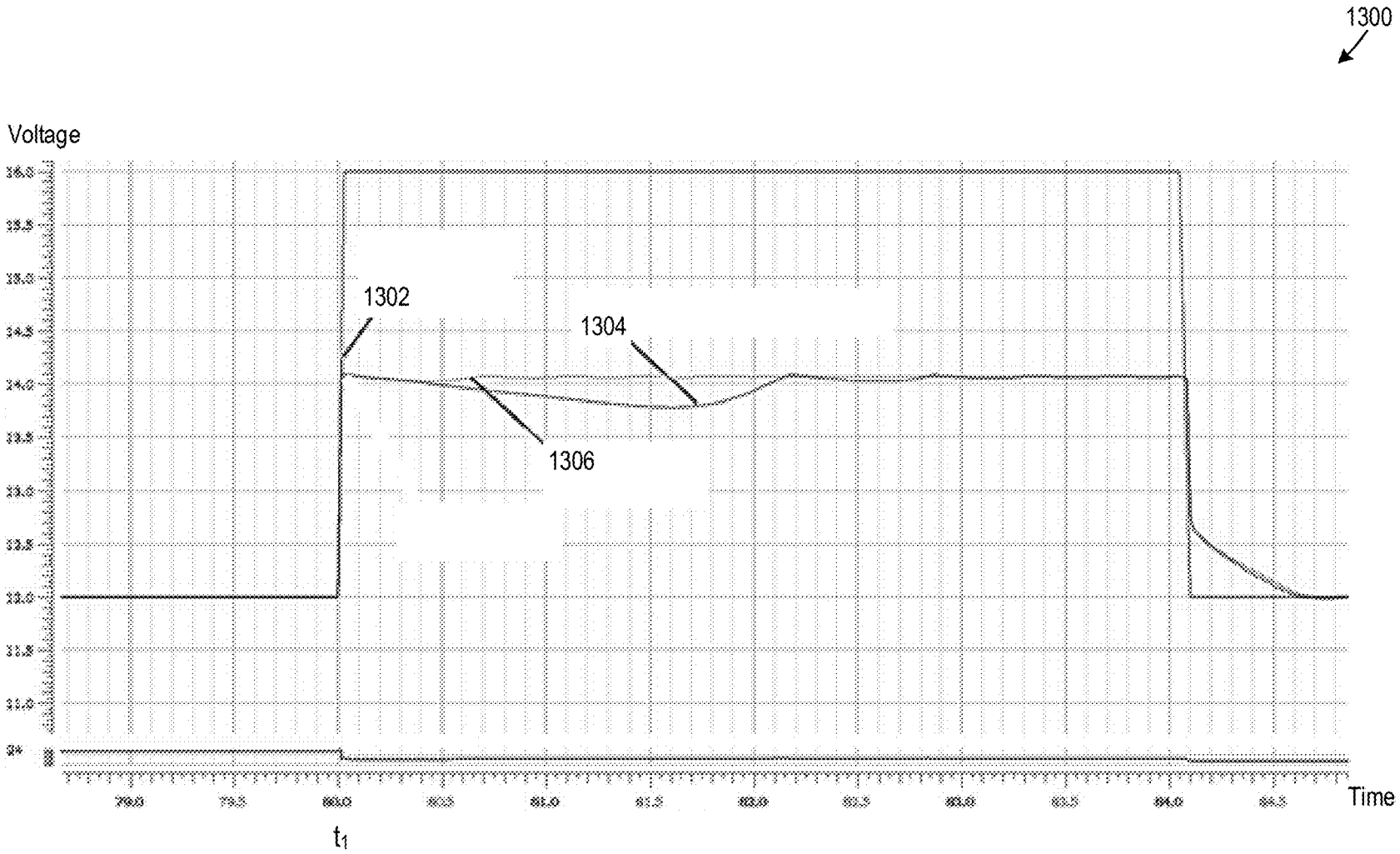
FIG. 13 is a graph of simulated voltage versus time for each of the FIGS. 2 and 6 linear regulators.
Figure 14:
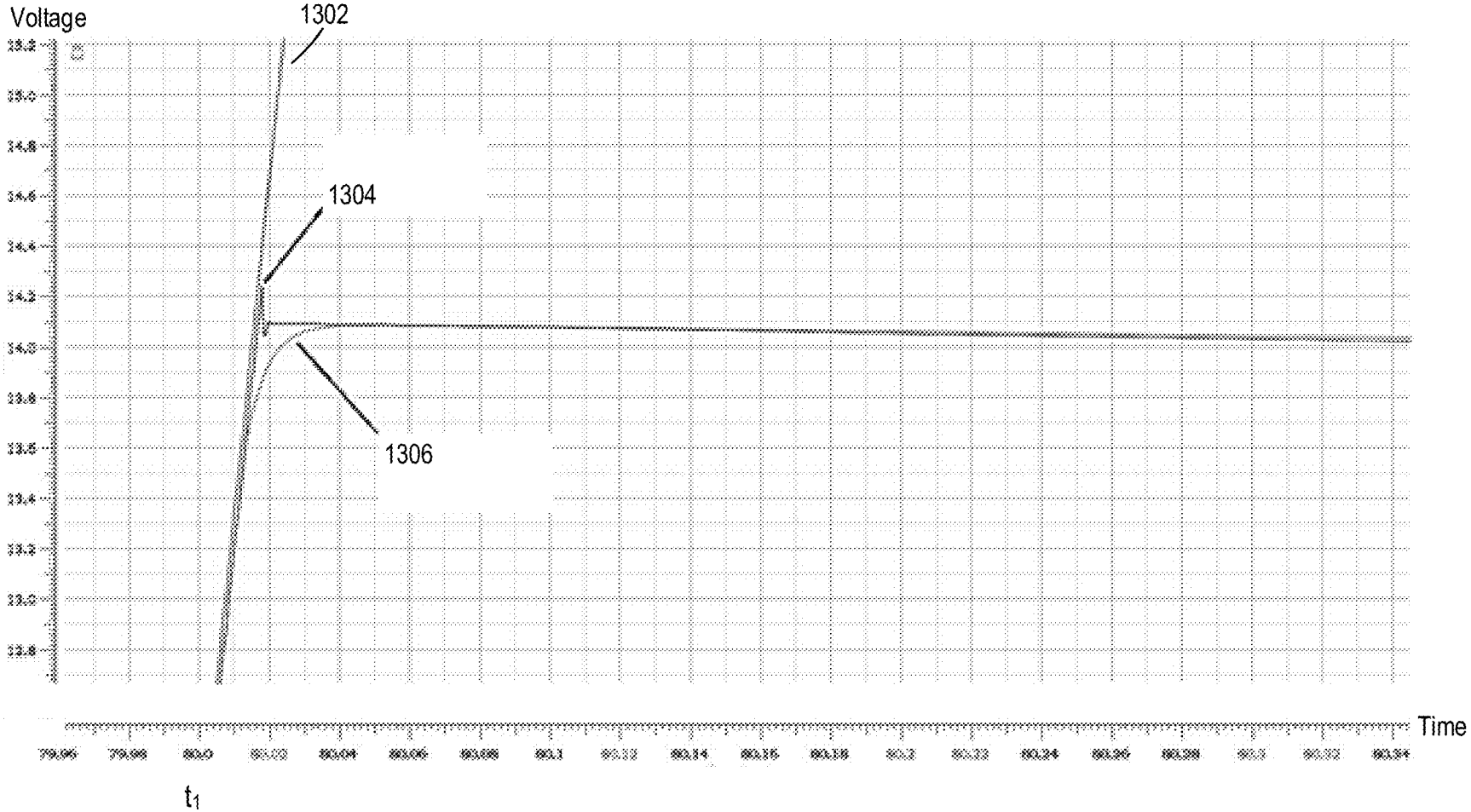
FIG. 14 is a close-up of a portion of the FIG. 13 graph.

The fact that linear regulators 300, 400, 500, 600, 700, 800, 900, 1000, 1100, and 1200 control their respective series-pass transistors according to at least a current sense signal and a voltage sense signal advantageously promotes control loop stability and good transient response. For example, FIG. 13 is a graph 1300 of simulated voltage versus time at light load for each of linear regulators 200 and 600. Curve 1302 represents input voltage $V_i$, curve 1304 represents output voltage $V_o$ of linear regulator 200 (FIG. 2), and curve 1306 represents output voltage $V_o$ of linear regulator 600 (FIG. 6). At time $t_1$, input voltage $V_i$ on both of linear regulators 200 and 600 rapidly increases from 12V to 16V to simulate an input voltage surge. FIG. 14 shows a close-up of a portion of FIG. 13 around time $t_1$. As evident from FIGS. 13 and 14, linear regulator 600 has a significantly better transient response than linear regulator 200 in response to the input voltage surge at time $t_1$. For example, there is significantly less output voltage ringing on linear regulator 600 than on linear regulator 200. Additionally, linear regulator 600 does not exhibit overshoot while linear regulator 200 exhibits significant overshoot, as visible in FIG. 14.

Figure 15:
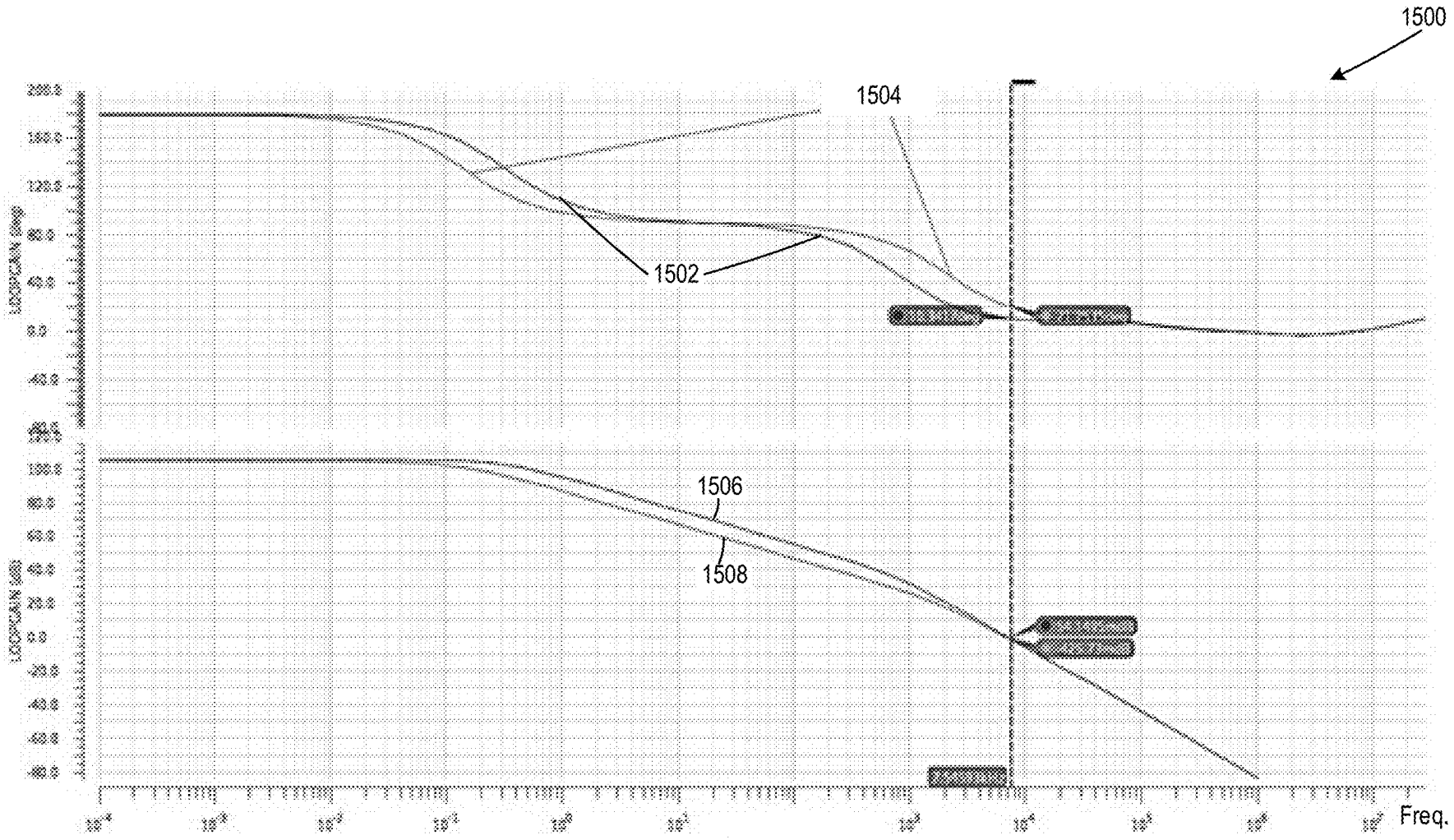
FIG. 15 is a graph of simulated control loop gain and phase versus frequency for each of the FIGS. 2 and 6 linear regulators.

Furthermore, FIG. 15 is a graph 1500 of simulated control loop gain and phase versus frequency at light load for each of linear regulators 200 and 600. Curve 1502 represents control loop phase of linear regulator 200, curve 1504 represents control loop phase of linear regulator 600, curve 1506 represents control loop gain of linear regulator 200, and curve 1508 represents control loop gain of linear regulator 600. As illustrated in FIG. 15, linear regulator 200 has a phase margin of about 10 degrees, and linear regulator 600 has a phase margin of about 21 degrees, where phase margin is control loop phase at zero control loop gain. Thus, linear regulator 600 has over twice the phase margin of linear regulator 200 at light load, thereby causing linear regulator 600 to be significantly more stable at light load than linear regulator 200.

Figure 16:
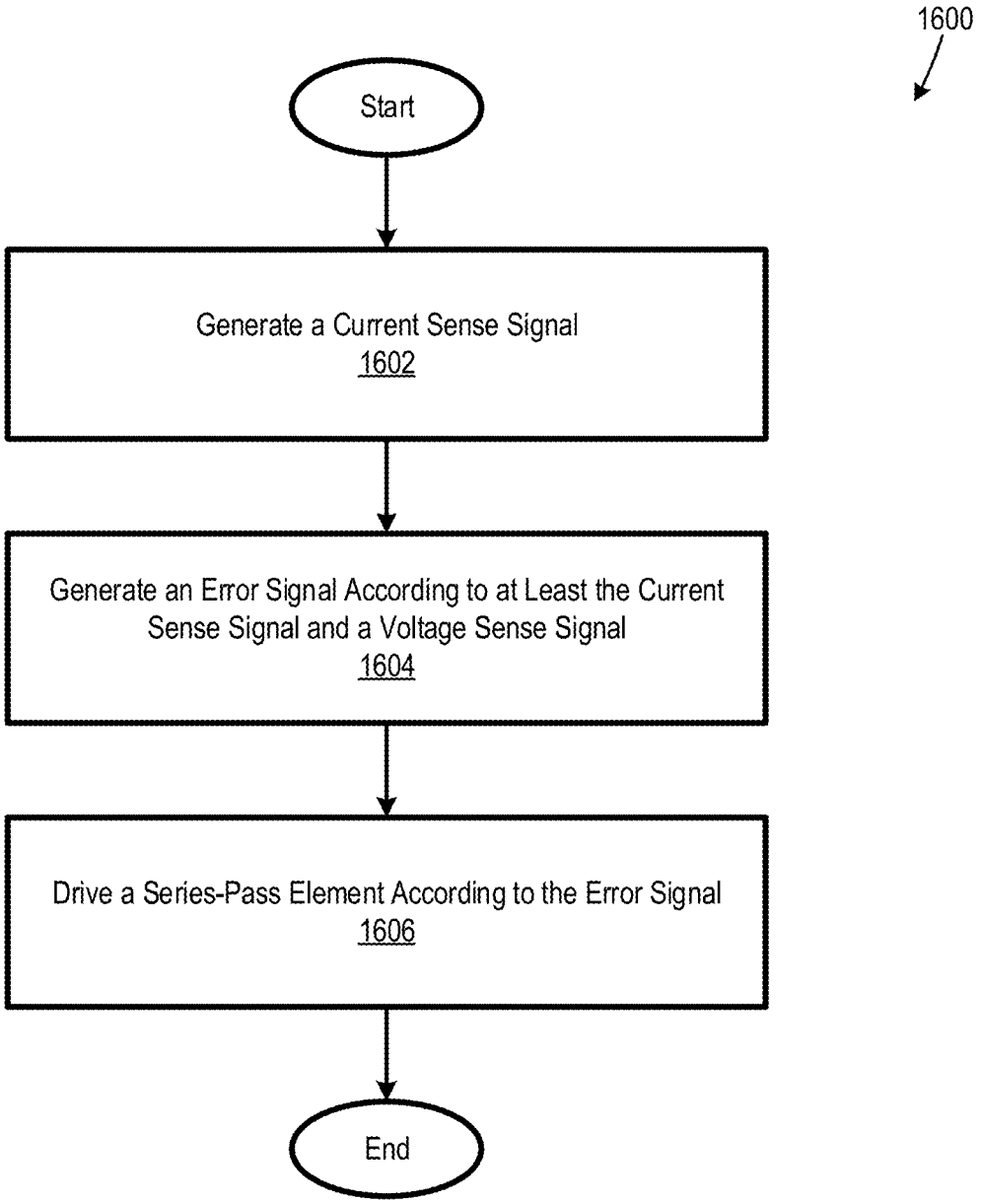
FIG. 16 illustrates a method for controlling a linear regulator, according to an embodiment.

FIG. 16 illustrates a method for controlling a linear regulator. In a step 1602, a current sense signal is generated, where the current sense signal represents at least magnitude of current flowing through a series-pass element of the linear regulator. In one example of step 1602, current sense circuitry 304 generates a current sense signal $S_c$ representing magnitude of current I flowing through transistor 302 of linear regulator 300 (FIG. 3). In another example of step 1602, current sense circuitry 604 generates a current sense signal $S_c$ representing magnitude of current I flowing through transistor 602 of linear regulator 600 (FIG. 6).

In a step 1604, an error signal is generated according to at least the current sense signal and a voltage sense signal, where the voltage sense signal represents magnitude of voltage at an output node of the linear regulator, e.g., an output voltage. In one example of step 1604, error signal circuitry 316 generates error signal $S_e$ according to at least current sense signal $S_c$ and voltage sense signal $S_v$ (FIG. 3). In another example of step 1604, summation device 628 and amplifier 630 collectively generate error signal $S_e$ according to at least current sense signal $S_c$ and voltage sense signal $S_v$ (FIG. 6).

In step 1606, the series-pass element of the linear regulator is driven according to the error signal, e.g., to clamp the magnitude of the output voltage to a maximum value, such that the magnitude of the output voltage decreases with increasing magnitude of current flowing through the series-pass element. In one example of step 1606, driver circuitry 318 drives transistor 302 according to error signal $S_e$ (FIG. 3). In another example of step 1606, driver circuitry 632 drives transistor 602 according to error signal $S_e$ (FIG. 6).

Combinations of Features

Features described above may be combined in various ways without departing from the scope hereof. The following examples illustrate some possible combinations:

(A1) A linear voltage regulator may include a series-pass element electrically coupled between an input node and an output node, current sense circuitry configured to generate a current sense signal representing at least magnitude of current flowing through the series-pass element, and control circuitry. The control circuitry may be configured to control the series-pass element according to at least (1) the current sense signal and (2) a voltage sense signal representing magnitude of an output voltage, to clamp the magnitude of the output voltage to a maximum value, the output voltage being a voltage at the output node, such that the magnitude of the output voltage decreases with increasing magnitude of current flowing through the series-pass element.

(A2) In the linear voltage regulator denoted as (A1), the series-pass element may include a transistor.

(A3) In the linear voltage regulator denoted as (A2), the current sense circuitry may be configured to generate the current sense signal such that the current sense signal is a linear function of at least magnitude of the current flowing through the transistor.

(A4) In the linear voltage regulator denoted as (A2), the current sense circuitry may be configured to generate the current sense signal such that the current sense signal is a non-linear function of magnitude of the current flowing through the transistor.

(A5) In any one of the linear voltage regulators denoted as (A2) through (A4), the control circuitry may include (1) error signal circuitry configured to generate an error signal according to the current sense signal and the voltage sense signal and (2) driver circuitry configured to drive the transistor according to the error signal.

(A6) In the linear voltage regulator denoted as (A5), the error signal circuitry may be configured to modulate the error signal according to the current sense signal.

(A7) In any one of the linear voltage regulators denoted as (A5) and (A6), the control circuitry may be further configured to control the transistor according to a sum of the current sense signal and the voltage sense signal.

(A8) In the linear voltage regulator denoted as (A7), the error signal circuitry may include (1) a summation device configured to sum the current sense signal and the voltage sense signal to generate a feedback sum signal and (2) an amplifier configured to generate the error signal according to a difference between the feedback sum signal and a reference signal representing magnitude of a reference voltage.

(A9) In the linear voltage regulator denoted as (A8), the amplifier may be further configured to have a gain that is proportional to the current sense signal.

(A10) In any one of the linear voltage regulators denoted as (A8) and (A9), the control circuitry may be further configured to control the transistor such that the magnitude of the output voltage is clamped to a maximum value that is proportional to magnitude of the voltage represented by the reference signal.

(A11) In any one of the linear voltage regulators denoted as (A2) through (A10), the transistor may include a metal oxide semiconductor field effect transistor (MOSFET), and the driver circuitry may include (1) bias circuitry configured to electrically bias a gate of the MOSFET and (2) a modulation transistor configured to linearly modulate voltage at the gate of the MOSFET according to the error signal.

(A12) Any one of the linear voltage regulators denoted as (A2) through (A11) may further include current limiting circuitry configured to cooperate with the control circuitry to control the transistor to limit magnitude of the current flowing through the transistor.

(A13) In the linear voltage regulator denoted as (A12), the current sense circuitry and the current limiting circuitry may share a common current sensing element.

(B1) A method for controlling a linear voltage regulator may include (1) generating a current sense signal representing at least magnitude of current flowing through a series-pass element of the linear voltage regulator, (2) generating an error signal according to at least the current sense signal and a voltage sense signal, the voltage sense signal representing magnitude of an output voltage, the output voltage being a voltage at an output node of the linear voltage regulator, and (3) driving the series-pass element of the linear voltage regulator according to the error signal to clamp the magnitude of the output voltage to a maximum value, such that the magnitude of the output voltage decreases with increasing magnitude of current flowing through the series-pass element.

(B2) In the method denoted as (B1), the series-pass element may include a transistor.

(B3) In any one of the methods denoted as (B1) and (B2), the step of generating the error signal may include (1) summing the current sense signal with the voltage sense signal to yield a feedback sum signal and (2) amplifying a difference between the feedback sum signal and a reference signal to yield the error signal.

(B4) In the method denoted as (B3), the step of amplifying may include modulating an amplifier gain according to the current sense signal.

(B5) Any one of the methods denoted as (B1) through (B4) may further include modulating the error signal according to the current sense signal.

(B6) In any one of the methods denoted as (B1) through (B5), the step of generating the current sense signal may include generating the current sense signal such that the current sense signal is a linear function of magnitude of the current flowing through the transistor.

(B7) In any one of the methods denoted as (B1) through (B5), the step of generating the current sense signal may include generating the current sense signal such that the current sense signal is a non-linear function of magnitude of the current flowing through the transistor.

Changes may be made in the above linear regulators and methods without departing from the scope hereof. It should thus be noted that the matter contained in the above description and shown in the accompanying drawings should be interpreted as illustrative and not in a limiting sense. The following claims are intended to cover generic and specific features described herein, as well as all statements of the scope of the present embodiments, which, as a matter of language, might be said to fall therebetween.

What is claimed is:

1. A surge stopper, comprising:

a series-pass element electrically coupled between an input node and an output node;

current sense circuitry configured to generate a current sense signal ($S_c$) representing at least magnitude of current flowing through the series-pass element; and control circuitry configured to control the series-pass element according to at least (a) the current sense signal ($S_c$) and (b) a voltage sense signal ($S_v$) representing magnitude of an output voltage, to clamp the magnitude of the output voltage to a maximum value, the output voltage being a voltage at the output node, such that the magnitude of the output voltage decreases with increasing magnitude of current flowing through the series-pass element, wherein the control circuitry includes:

(i) error signal circuitry configured to generate an error signal ($S_e$) according to an expression $S_e=(A+\alpha S_c)(S_v+\beta S_c)$, where each of A, $\alpha$, and $\beta$ is a constant, and (ii) driver circuitry configured to drive the series-pass element according to the error signal (Se).

2. The surge stopper of claim 1, wherein the series-pass element comprises a transistor.

3. The surge stopper of claim 2, wherein the current sense circuitry is configured to generate the current sense signal ($S_c$) such that the current sense signal ($S_c$) is a linear function of at least magnitude of the current flowing through the transistor.

4. The surge stopper of claim 2, wherein the current sense circuitry is configured to generate the current sense signal ($S_c$) such that the current sense signal ($S_c$) is a non-linear function of magnitude of the current flowing through the transistor.

5. The linear voltage regulator of claim 1, wherein the error signal circuitry comprises:

a summation device configured to sum the current sense signal ($S_c$) and the voltage sense signal ($S_v$) to generate a feedback sum signal; and an amplifier configured to generate the error signal ($S_e$) according to a difference between the feedback sum signal and a reference signal representing magnitude of a reference voltage.

6. The surge stopper of claim 2, wherein:

the transistor comprises a metal oxide semiconductor field effect transistor (MOSFET); and the driver circuitry includes:

bias circuitry configured to electrically bias a gate of the MOSFET, and a modulation transistor configured to linearly modulate voltage at the gate of the MOSFET according to the error signal ($S_e$).

7. The surge stopper of claim 2, further comprising current limiting circuitry configured to cooperate with the control circuitry to control the transistor to limit magnitude of the current flowing through the transistor.

8. The surge stopper of claim 7, wherein the current sense circuitry and the current limiting circuitry share a common current sensing element.

9. The surge stopper of claim 1, wherein the error signal circuitry comprises:

a summation device configured to sum the current sense signal ($S_c$) and the voltage sense signal ($S_v$) to generate a feedback sum signal; and an amplifier configured to generate the error signal ($S_e$) according to a difference between the feedback sum signal and a reference signal representing magnitude of a reference voltage.

10. The surge stopper of claim 9, wherein the amplifier is further configured to have a gain that is proportional to the current sense signal ($S_e$).

11. A method for controlling a surge stopper, comprising:

generating a current sense signal ($S_c$) representing at least magnitude of current flowing through a series-pass element of the surge stopper;

generating an error signal ($S_e$) according to at least the current sense signal ($S_c$) and a voltage sense signal ($S_v$), the voltage sense signal ($S_v$) representing magnitude of an output voltage, the output voltage being a voltage at an output node of the surge stopper, wherein the step of generating the error signal ($S_e$) includes generating the error signal ($S_e$) according to an expression $S_e=A[S_v(1+\beta S_c)-S_r]$, where each of A and $\beta$ is a constant and $S_r$ is a reference signal; and driving the series-pass element of the surge stopper according to the error signal ($S_e$) to clamp the magnitude of the output voltage to a maximum value, such that the magnitude of the output voltage decreases with increasing magnitude of current flowing through the series-pass element.

12. The method of claim 11, wherein the series-pass element comprises a transistor.

13. The method of claim 12, wherein the step of generating the current sense signal ($S_c$) comprises generating the current sense signal ($S_c$) such that the current sense signal ($S_c$) is a linear function of magnitude of the current flowing through the transistor.

14. The method of claim 12, wherein the step of generating the current sense signal ($S_c$) comprises generating the current sense signal ($S_c$) such that the current sense signal ($S_c$) is a non-linear function of magnitude of the current flowing through the transistor.

15. The method of claim 11, wherein the step of generating the error signal ($S_e$) comprises:

summing the current sense signal ($S_c$) with the voltage sense signal ($S_v$) to yield a feedback sum signal; and amplifying a difference between the feedback sum signal and a reference signal to yield the error signal ($S_e$).

16. The method of claim 15, wherein the step of amplifying comprises modulating an amplifier gain according to the current sense signal ($S_c$).

* * * * *